US005149563A

United States Patent [19]

Collier

[11] Patent Number: 5,149,563

[45] Date of Patent: Sep. 22, 1992

[54] METHOD FOR ELECTROSTATICALLY COATING PLASTER MANDRELS

[75] Inventor: Scott M. Collier, Tacoma, Wash.

[73] Assignee: The Boeing Company, Seattle, Wash.

[21] Appl. No.: 711,674

[22] Filed: Jun. 6, 1991

[51] Int. Cl.[5] ..... B05D 1/04

[52] U.S. Cl. ..... 427/27; 264/22; 425/174.8 E; 118/624

[58] Field of Search ..... 118/629, 500; 239/706; 427/13, 27, 133; 425/174.6, 174.8 E; 264/22, 24

[56] References Cited

U.S. PATENT DOCUMENTS 3,408,985 11/1968 Sedlacsik ..... 118/629

3,833,174 9/1974 Sarzen ..... 239/706

*Primary Examiner*—W. Gary Jones

*Assistant Examiner*—Charles K. Friedman

*Attorney, Agent, or Firm*—Conrad O. Gardner; B. A. Donahue

[57] ABSTRACT

A method for electrostatically coating plaster mandrels by making the mandrels electrically conductive, thereby facilitating electrostatic painting or spraying, by embedding a ground strap into the mandrel which is in an electrically conductive "green" or uncured state due to its free water content after it was slosh formed in a rotating mold. The plaster mandrels are then electrostatically coated before the green plaster dries and cures.

1 Claim, 2 Drawing Sheets

METHOD FOR ELECTROSTATICALLY COATING PLASTER MANDRELS

FIELD OF THE INVENTION

The field of the invention is electrostatic coating or painting of plaster tooling such as male or female molds. An object of the invention is to use the conductive properties of green plaster to conduct an electrostatic charge to ground for purposes of applying a lacquer parting or release film to plaster tool surfaces.

The advantages of electrostatic painting are as follows:

1) 60% reduction in paint use.
2) Better coating providing smoother finish surface.
3) Fewer harmful vapors released into the air.
4) Less disposable toxic waste in the form of overspray, paint clogged filters, and contaminated waterfall filter water.
5) Allow painting which is environmentally sound.
6) Better coverage reduces the number of coats required, saving labor.

Plaster is used to make hollow tooling for the manufacture of fiber reinforced plastic products. Ducting for aircraft cabin air conditioning and heating systems is made by wrapping uncured pre-preg (preimpregnated fiberglass or kevlar) around a plaster mandrel. The complex shapes of the parts requires the tooling to be hollow, have multiple appendages of differing sizes and shapes, and allow the part to be made in one piece. This creates a lock-on condition which requires the tooling to be broken and removed after the fiber reinforced plastic pre-preg is cured or hardened. Such complexity also makes the use of other conductive media such as internal wiring or screen material difficult.

To facilitate total removal of the plaster and to produce a relatively smooth inside surface on the finished part, the plaster tool must be coated with a release film or parting lacquer. This lacquer is currently applied to the surface using conventional airless or air assisted spray equipment. The use of electrostatic spray equipment has not been possible due to the non-conductive nature of dried plaster. Dried plaster is defined as having no free water in it. Dry plaster does contain crystalline water, but it is not conductive.

The state of the prior art is exemplified in the patent literature by several methods to render objects electrically conductive during electrostatic surface finishing. U.S. Pat. No. 3,496,911 to Chmelar discloses a method utilizing adhesives that are wet or high in humidity to improve conductivity during electrostatic flocking. U.S. Pat. No. 3,644,132 to Gelin relates to a gel coat process whereby ground conductors are molded into a non-conducting wall, and are in contact with the gel coat which is sprayed electrostatically onto the wall. U.S. Pat. No. 3,833,174 to Sarzen relates to an electrostatic flocking method whereby an electrode is embedded into electrically conductive adhesive. Soviet Patent 326204 discloses a method of electrostatic varnishing wood by increasing the conductivity of the wood surface with an emulsion wetted by keeping it in 100% humidity.

SUMMARY OF THE INVENTION

Having in mind the limitations of the prior art which utilizes wet conductive articles applied as an added step to facilitate electrostatic surface finishing, and present efforts which limit coating of plaster tools with release film or parting lacquer which is applied to the surface using conventional airless or air assisted spray equipment, the present invention in contrast, enables the use of electrostatic spray equipment without adding extra coatings or steps.

According to the present invention, a method is utilized for making plaster mandrels electrically conductive for electrostatically spray painting which consists of embedding a ground strap into the mandrel which is in an electrically conductive "green" or uncured state after it is slosh formed in a rotating mold. Thus, the mandrels are electrostatically coated while the plaster is green.

These and other aspects and advantages of the invention may be best understood by reference to the following detailed description of the preferred embodiment when considered in conjunction with the accompanying drawings.

DESCRIPTION OF THE PREFERRED EMBODIMENT

Figure 1:
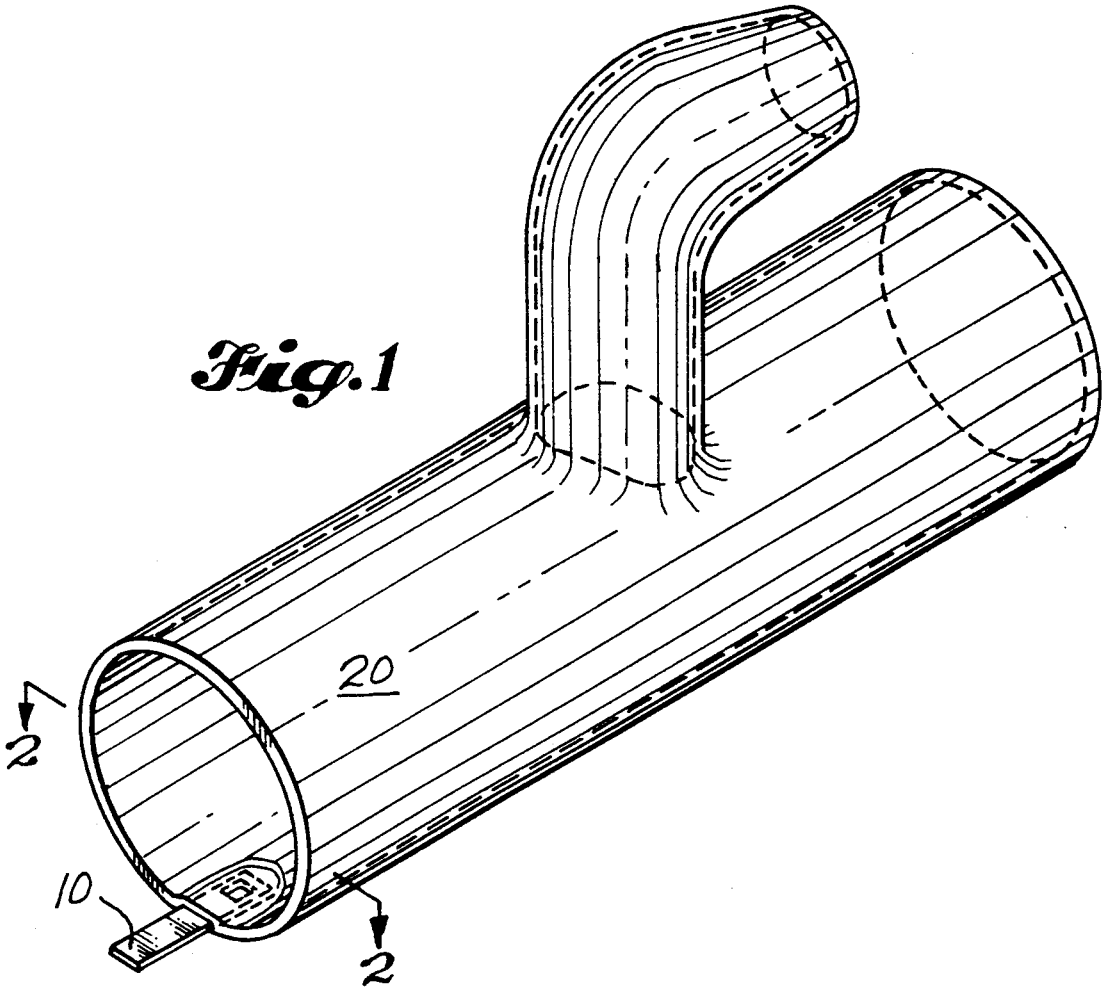
FIG. 1 is a perspective view of the plaster mandrel assembly utilized in the present electrostatic coating method.
Figure 2:
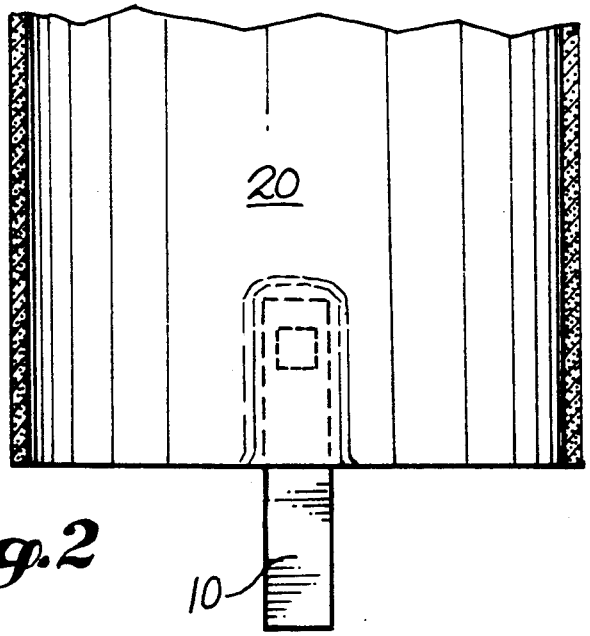
FIG. 2 is a sectional view taken along the lines 2—2 of the plaster mandrel assembly of FIG. 1 showing in more detail a terminal for making electrical contact with the green plaster of the plaster mandrel assembly of FIG. 1; and, FIG. 3 is illustrative of the apparatus used in the present method for electrostatic coating utilizing a plaster tool surface utilizing the mandrel assembly of FIGS. 1 and 2.

The present method of electrostatic coating of a plaster mandrel 20 is commenced by preparing the plaster mandrel 20 as shown in FIGS. 1 and 2. More specifically, to establish electrical contact with the free water in the green plaster of plaster mandrel 20 while it is in its uncured state, a short electrically conductive ground terminal 10 comprising a short metal wire segment or strap is cast into plaster mandrel 20 as the last coat of plaster is applied in the sloshing process. Sloshing is the process of coating the inside of a light weight female mold with liquid plaster. Several layers of liquid plaster build sufficient wall thickness for plaster mandrel 20 to support its own weight. Then the female mold (not shown) is removed from plaster mandrel 20.

Electrically conductive ground terminal 10 provides electrical contact with the green plaster of plaster mandrel 20 even after the outer surface of plaster mandrel 20 is cured to a dry crust due to exposure to air. The dry outer surface of plaster mandrel 20 electrically insulates the electrically conductive inner green plaster of plaster mandrel 20 thereby precluding clamping electrically conductive ground terminal 10 to the outer surface of plaster mandrel 20. Notwithstanding a dried outer surface, the mandrel 20 may be electrostatically coated so long as the inner portion has not dried or cured. Thus, only one conductive ground terminal 10 is required for plaster mandrel 20 since adequate electrical conductivity is provided while plaster is in the green or uncured state.

Figure 3:
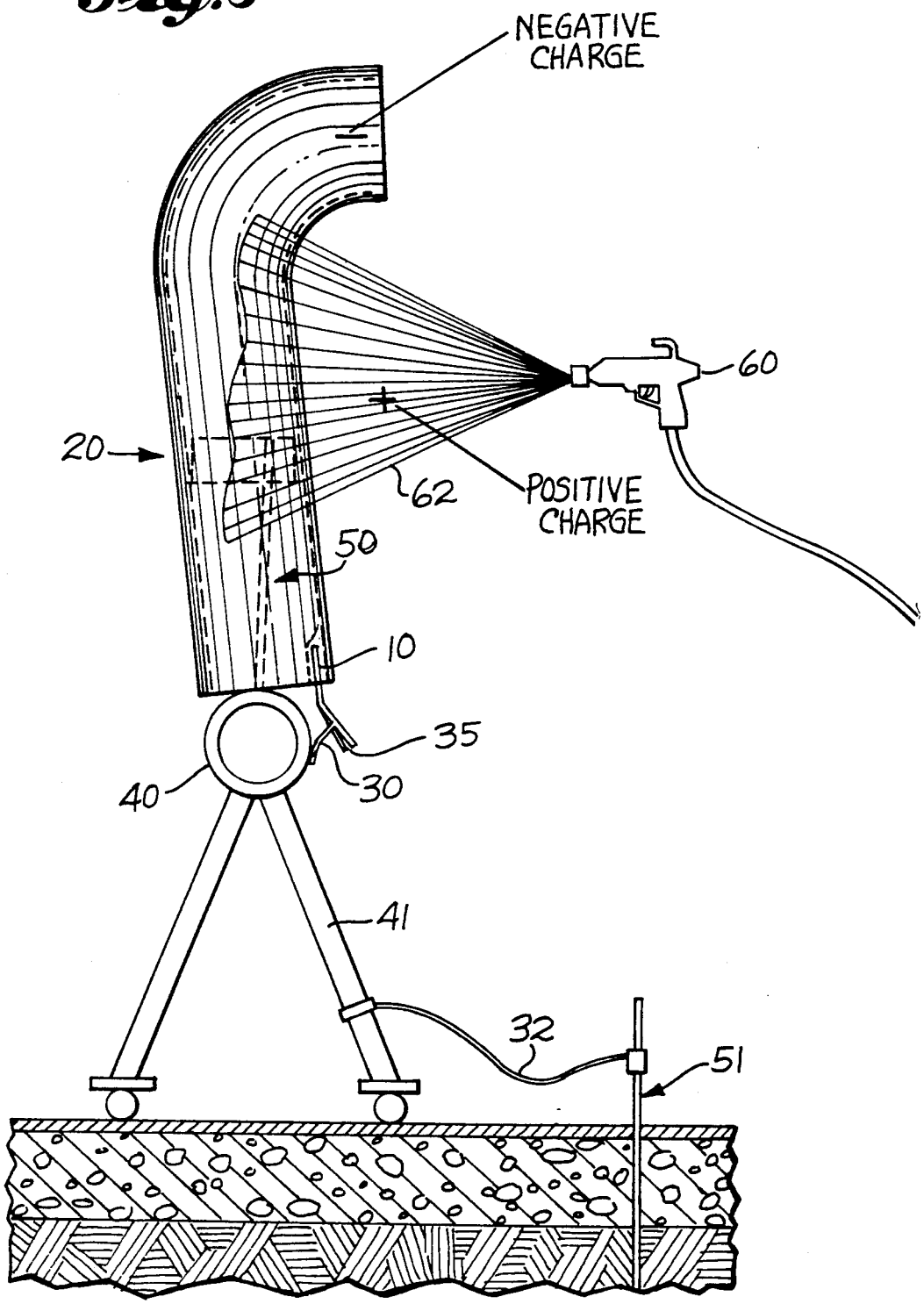

As seen in FIG. 3, conductive ground terminal 10 is disposed adjacent to electrical terminal 30 of electrically conductive metal painting rack 40 so that alligator clip 35 can make an electrical connection therebetween. Electrically conductive metal painting rack 40 has a support member 50 for each plaster mandrel 20 (only one shown in FIG. 3) to be painted. A leg 41 of metal painting rack 40 is electrically connected by electrically conductive wire 32 to ground post 51 which circuit is closed through spray gun 60 when positively charged lacquer or paint 62 leaves spray gun 60 and is attracted to grounded (negatively charged) plaster mandrel 20.

Insofar as the lacquer formula used in the present electrostatic coating system is concerned, a quick initial solvent flash-off is preferred to avoid moisture contamination of the paint. It will be recognized that by adjusting the solvent balance of slower solvents in lacquer, performance of the paint can be improved with regard to shrinkage, adhesive to the plaster, and surface quality.

The mandrels can be partially dried while still maintaining conductive qualities. This is beneficial to the cure of the epoxy prepreg as water in the plaster, if drying is incomplete, can keep epoxy curing temperature below what is required for complete cure.

Maximum resistances are as follows:

1. Paint or coating resistance range when wet is 2/10 to 6/10 megaohms.
2. Mandrel resistance range is 0 to 0.8 megaohms (at this point the mandrel is partially dry).

What is claimed is:

1. A method for electrostatically spraying a plaster mandrel supported on a painting rack utilizing a spray gun, said method comprising:

positioning an electrically conductive ground terminal in an uncured portion of said plaster mandrel;

closing an electrical circuit path between said electrically conductive ground terminal and said painting rack; and, closing an electrical circuit path between said painting rack and said spray gun.

* * * * *